United States Patent [19]

Sjogren et al.

[11] Patent Number: 4,562,339

[45] Date of Patent: Dec. 31, 1985

[54] INSERTED PRODUCT NEWSPAPER SENSOR

[75] Inventors: Christer A. Sjogren, Miami; John McRae, Pembroke Pines; Carlos Reyes, Miami, all of Fla.

[73] Assignee: Quipp, Incorporated, Hialeah, Fla.

[21] Appl. No.: 609,448

[22] Filed: May 11, 1984

[51] Int. Cl.[4] ..... G06M 7/06

[52] U.S. Cl. ..... 235/98 R; 235/98 B; 377/8

[58] Field of Search ..... 235/98 R–98 C, 235/131 R, 131 M, 134, 144 HC; 377/8; 198/503

[56] References Cited

U.S. PATENT DOCUMENTS

| | | | |
|---|---|---|---|
| 3,279,697 | 10/1966 | Buratti | 235/144 HC X |
| 3,577,955 | 5/1971 | Palmer | 235/98 B X |
| 3,702,925 | 11/1972 | Anderson et al. | 235/98 B X |
| 4,091,269 | 5/1978 | Schick | 235/98 B |
| 4,148,393 | 4/1979 | Wiseman | 235/98 B X |

*Primary Examiner*—Benjamin R. Fuller

[57] ABSTRACT

A sensor assembly having senser fingers swingably mounted upon a rotatable support and resiliently biased to extend radially outward. In the three-finger embodiment, a detent assembly rotatable with the support detents the support through a 120 degree rotation when the nose of a signature engages the finger lying in the path of signature movement. A one-way clutch cooperates with the detent assembly to dampen movement of the fingers and cooperating rotatable support to prevent oscillation of the rotating members. The finger advanced to the detent position slides upon the adjacent surface of the last counted signature and is freely yieldable to prevent irregularities in the signature from causing an erroneous count.

27 Claims, 30 Drawing Figures

INSERTED PRODUCT NEWSPAPER SENSOR

FIELD OF THE INVENTION

The present invention relates to signature counters and more particularly to a novel sensor especially adapted for use in sensing and counting signatures having one or more inserts arranged within or outside of the signature jacket and which is capable of preventing a wrong count due to irregularities in the signature profile.

BACKGROUND OF THE INVENTION

It is well known in the newspaper industry to employ inserting machines (i.e., stuffers) for the purpose of automatically introducing inserts into a signature. This technique is extremely advantageous in the publishing of Sunday newspapers. Many of the magazine inserts for the upcoming Sunday edition are printed well ahead of time, but cannot be inserted into the signature until the news part of the newspaper is printed.

In newspaper plants, it is typical to count the signatures in order to form signature bundles to determine accurate counts for proper control over delivery and distribution of the signatures.

The problem of accurately counting the stream of signatures leaving an insert machine is a difficult one due to the thickness of the signatures and the poor "nose" of the signature caused by the inserted products contained within the signature jacket.

The signature being delivered from a press has a distinct and well-defined nose (leading edge), which is used to great advantage for accurately sensing each signature, either through the use of a non-contact optical sensor or a more conventional electromechanical cog wheel type sensor.

Distinct signature nose almost never exists in signatures having inserts. The leading edge of a signature, frequently referred to as the nose, quite often has several humps caused by the plurality of inserted sections protruding through the skin of the jacket. These humps cause conventional counters to miscount.

Another problem which occurs with inserted products is the signature jacket is often at times missing due to misfeeds occurring in the insert machine. As a result, several of the insert sections of the newspapapers are spread out slightly and a conventional count sensor may erroneously pick up every insert section, or at least some of them, resulting in miscounts.

BRIEF DESCRIPTION OF THE INVENTION

The sensor of the present invention is designed to cope with all of the above problems and is characterized by comprising means for ignoring humps in a signature jacket, adjusting to different product thicknesses and ignoring multiple counts of loose inserted products due to a missing jacket.

The present invention comprises a rotating assembly having swingably mounted arms arranged at spaced intervals therearound and normally urged to extend radially outward by bias means associated with each arm. A cam means forming an integral part of the rotating assembly cooperates with a swingable, biased, detent arm to accurately detent the rotating assembly after rotation through the aforementioned predetermined interval, thereby accurately locating the next finger assembly in the proper sensing position.

The finger now in the signature sensing position slides upon the surface of the previously counted signature and is positioned to be engaged by the nose of the next following signature which imparts acceleration to the finger and thereby advances the rotating assembly. The operating cam and detent arm indexes the rotating assembly through the aforementioned predetermined angle to move the next sensing finger into the sensing position. The shape of the cam controls the indexing angle. In addition thereto, the rotating assembly is coupled to the mounting assembly through a one-way clutch mechanism, whereby rotation of the rotating assembly in a direction counter to its normal direction of rotation is prevented thereby preventing oscillation of the rotating assembly as it is indexed.

A plurality of permanent magnets, each associated with a sensing finger, are arranged at discrete angular positions about the rotating assembly and are sensed by a sensing element, such as, for example, a Hall-effect sensor to generate a signal which is utilized for signature counting purposes.

Although each sensing finger slideably engages the previously sensed signature, the configuration of each finger, coupled with the resilient mounting, enables the sensing finger to slide over inserts not contained within a jacket to thereby prevent the generation of an erroneous count while at the same time permitting even a blunt nose to cause rotation of the sensors in order to effect signature counting. The spacing and geometry of the sensor prevents the sensor from counting inserts and/or irregularities spaced less than a predetermined distance from the nose of the previously counted signature. The geometry of the sensor fingers and rotatable sensor support assembly prevents any irregularities or inserts not contained within the jacket from being erroneously counted as a signature whenever such irregularities fall within a less than a predetermined distance from the nose of the last coupled signature.

The rotating assembly is provided with a plurality of permanent magnet members, each associated with one of said sensing fingers. A sensing device such, as for example, a Hall-effect device for generating a signal employed for counting purposes. The ability of the pivotally mounted sensing fingers to follow irregularities in the signature jacket and the spacing between adjacent sensing fingers prevents any irregularities or misfed inserts contained within or outside of a signature jacket from being erroneously counted as a signature. The fingers will not count irregularities located less than a predetermined distance from the previous signature which caused rotation of the rotatable member thereby providing a capability of preventing the generation of an erroneous count, which features are not capable of being obtained through present day signature counters.

OBJECTS OF THE INVENTION AND BRIEF DESCRIPTION OF THE FIGURES

It is therefore one object of the present invention to provide a novel signature counter for accurately counting thick signatures containing inserts which inserts form irregularities in the signature jacket.

It is therefore another object of the present invention to provide a novel signature counter for accurately counting thick signatures containing inserts, which inserts have been misfed so as to lie outside of the signature jackets.

Still another object of the present invention is to provide a novel signature sensor designed to ignore irregularities which may be present in a signature stream and which irregularities occur within a predetermined distance from the nose of the last signature to be sent.

Other objects of the present invention will become apparent when reading the accompanying description and drawing in which:

FIG. 1 shows a right-hand side view of a signature sensor for sensing thick signatures and whose design embodies the principles of the present invention.

FIG. 1*a* shows a top side view of the sensor of FIG. 1.

FIG. 1*b* shows a rear elevational view of the sensor of FIG. 1.

FIGS. 1*c*, 1*d*, 1*e* and 1*f* shows side views of illustrative examples of thick signatures which may be counted by the sensor of FIG. 1.

Figure 3:
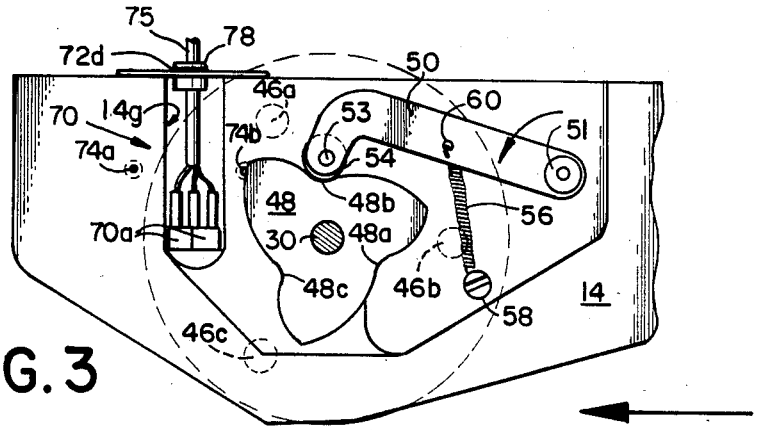
FIG. 3 shows the cam and cam follower assembly of the sensor looking in the direction of arrows 2—2 of FIG. 1*a*.
Figure 5A:
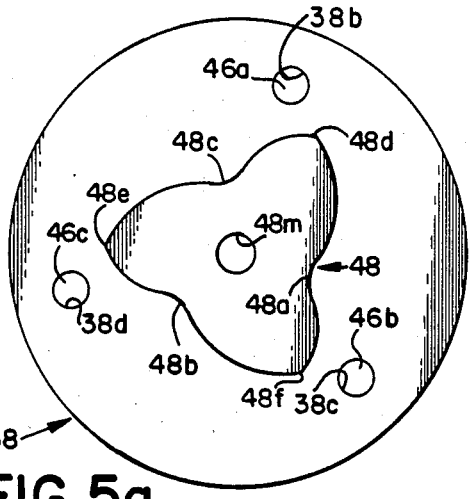
Figure 5B:
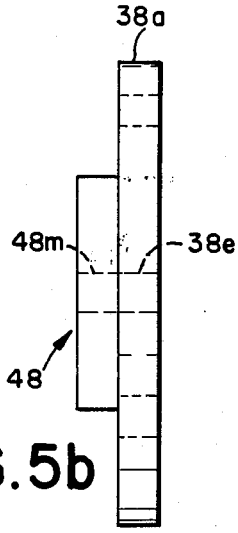
Figure 5C:
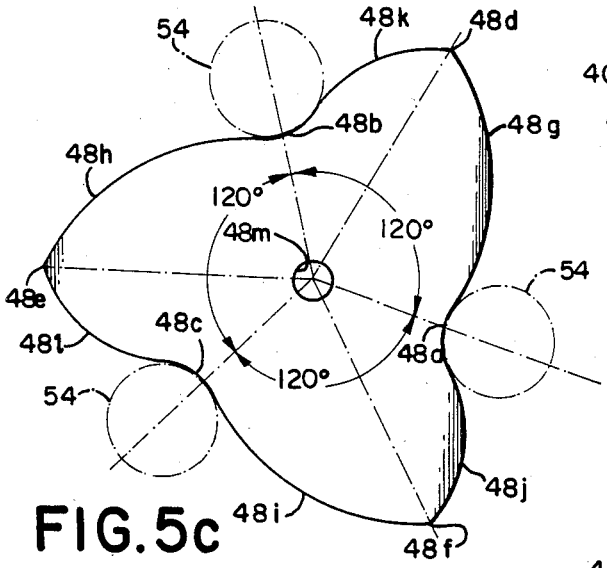

FIGS. 5*a*, 5*b* and 5*c* show side, end and enlarged views respectively of the sensing wheel and integral cam shown in FIG. 3.

Figure 2:
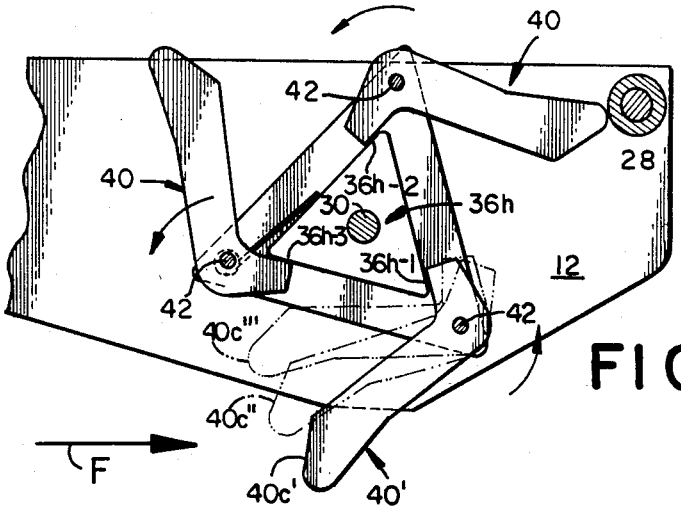
FIG. 2 shows the sensing finger assembly looking in the direction of arrows 1—1 of FIG. 1*a*.
Figure 6A:
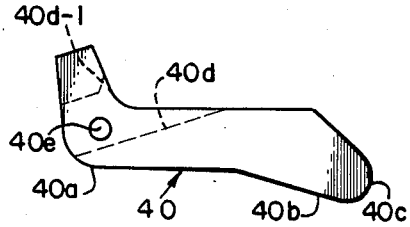
Figure 6B:
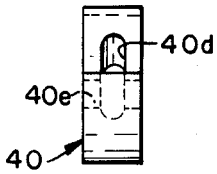
Figure 6C:
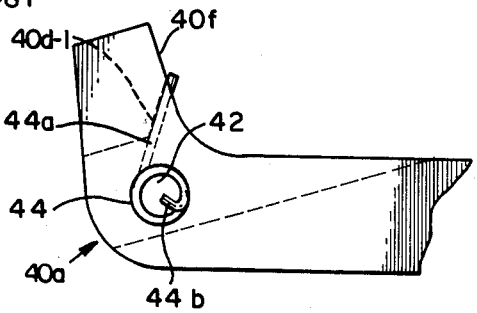

FIGS. 6*a*, 6*b* and 6*c* show side, end and enlarged detail views of one sensing finger shown, for example, in FIG. 2.

Figure 7A:
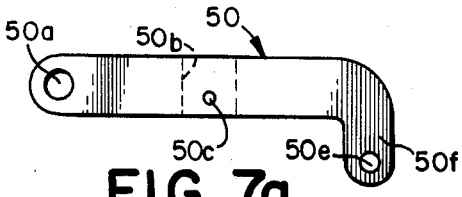
Figure 7C:
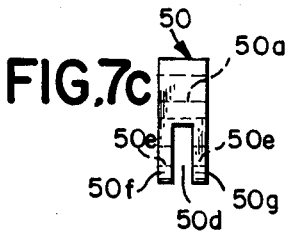
Figure 7B:
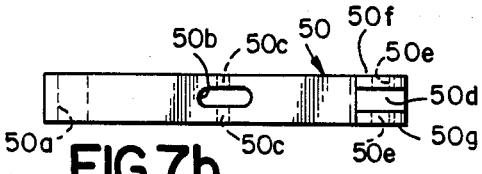

FIGS. 7*a* 7*b* and 7*c* show tab, side and end views of the cam follower pivot arm of FIG. 3.

Figure 1:
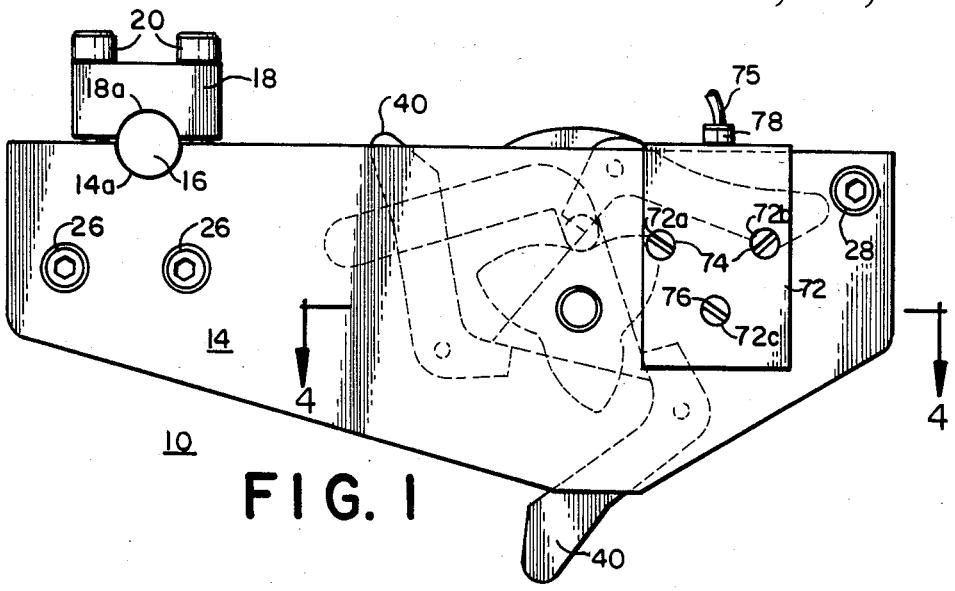
Figure 1A:
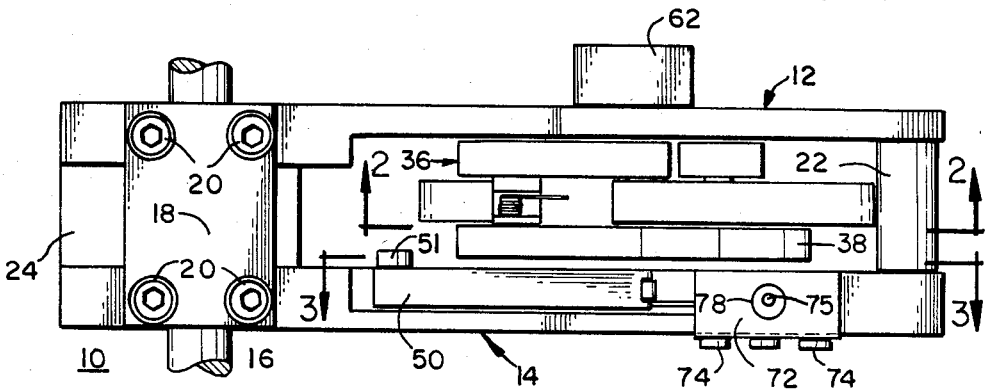
Figure 1B:
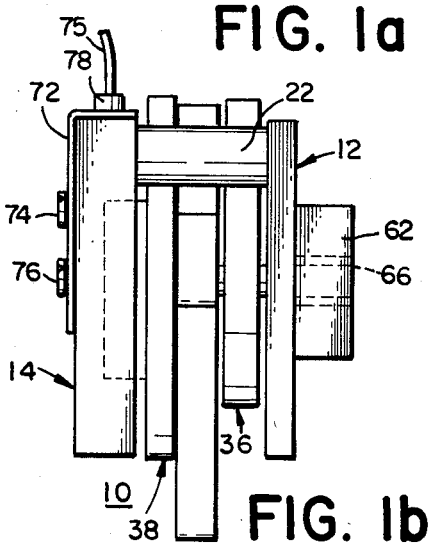
Figure 8B:
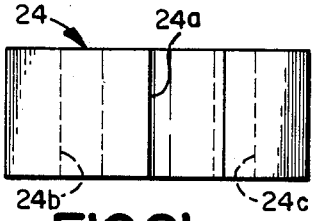
Figure 8A:
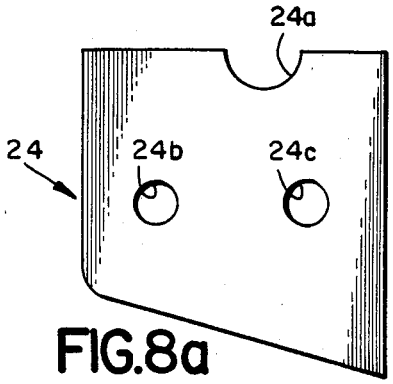
Figure 8C:
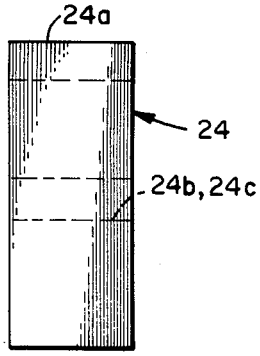

FIGS. 8*a*, 8*b* and 8*c* show side, top and rear elevational views respectively of the front spacer shown in FIG. 1*a*.

Figure 9A:
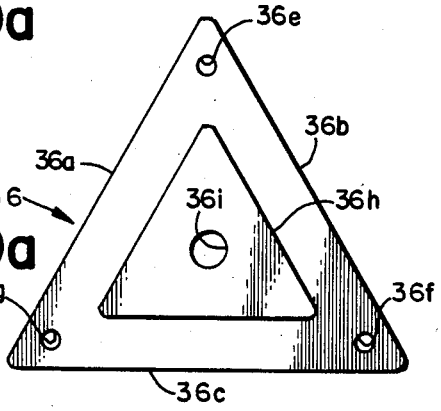
Figure 9B:
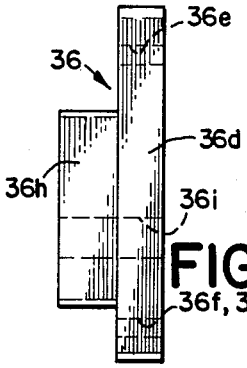

FIGS. 9*a* and 9*b* show side and end views respectively of the position wheel shown in FIG. 2.

Figure 4:
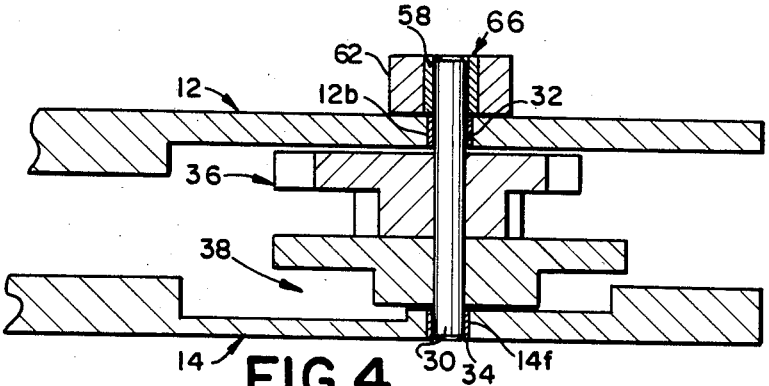
FIG. 4 shows a sectional view looking in the direction of arrows 3—3 of FIG. 1.
Figure 10A:
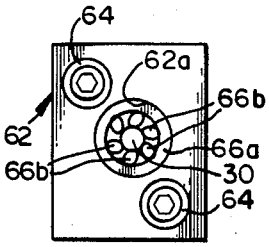
Figure 10B:
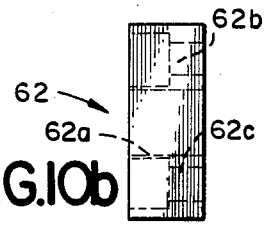

FIGS. 10*a* and 10*b* show side and end views of the clutch mounting block of FIG. 4.

Figure 11A:
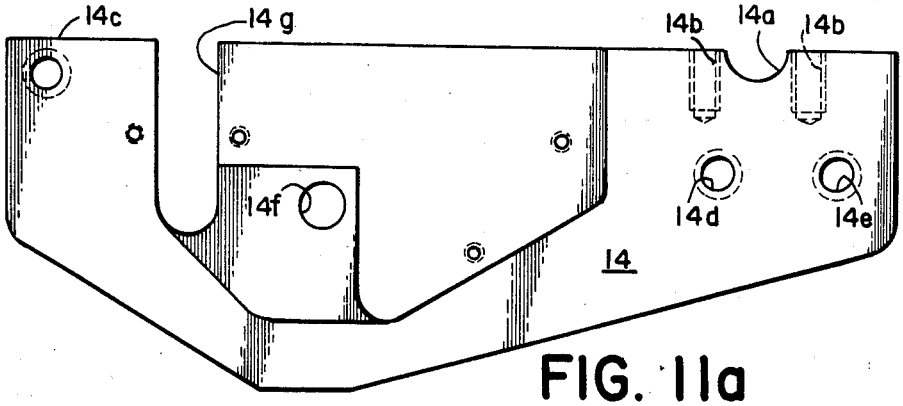
Figure 11B:
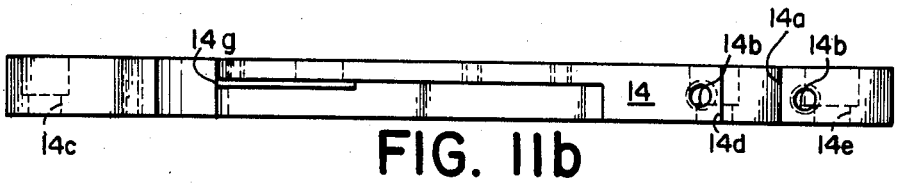

FIGS. 11*a* and 11*b* show top and internal views of the sensor right-hand side plate of FIG. 1.

Figure 12:
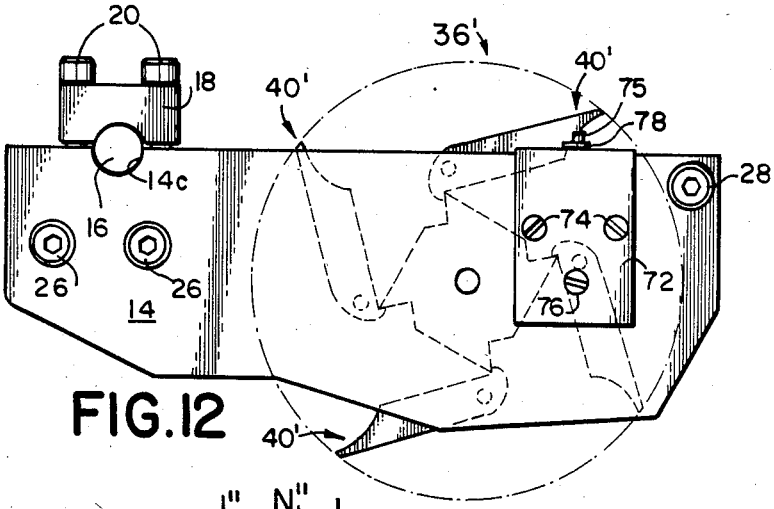

FIG. 12 is a side view of an aleternative embodiment of the invention.

Figure 13:
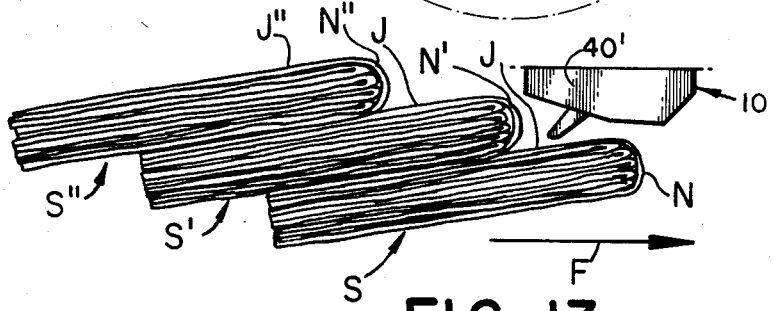

FIG. 13 is a simplified diagram showing the sensor adjacent to a signature stream using the signature counter of the present invention.

DETAILED DESCRIPTION OF THE INVENTION

Figure 1C:
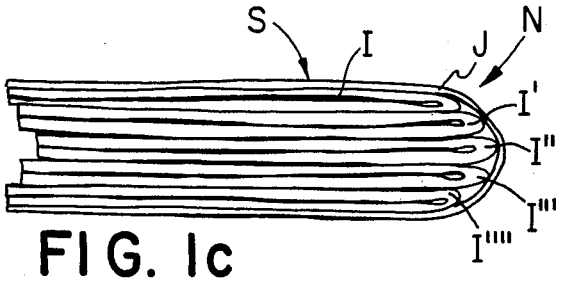
Figure 1D:
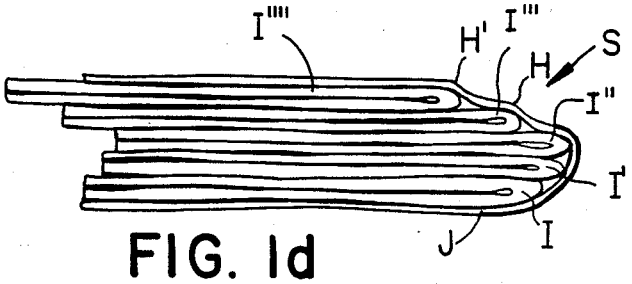
Figure 1E:
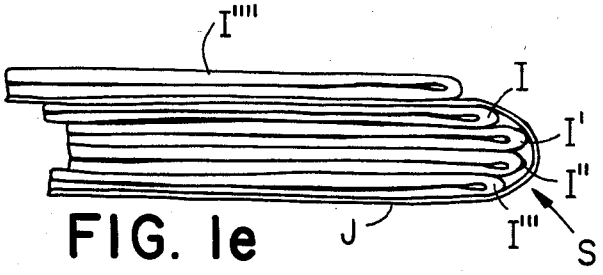

FIGS. 1*c* through 1*e* show signatures of the type which are capable of being counted by the sensor of the present invention.

Figure 1F:
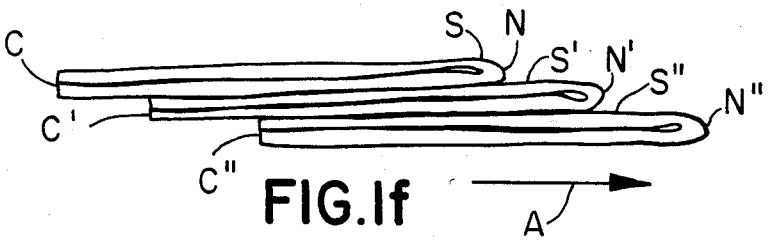

Signatures are normally fed in overlapping fashion. Noting for example FIG. 1*f*, there is shown therein signatures S, S' and S'' arranged in overlapping fashion. The direction of movement of the overlapping signature stream is shown by arrow A. Each signature is fed with its folded edge or nose N, N', N'' forward and with its cut edge C, C', C'' arranged as the trailing edge of the signature stream. For purposes of simplification, FIG. 1*f* shows only three signatures, it being understood that signatures are normally fed in a continuous overlapping stream and not in groups of three as shown in simplified fashion in FIG. 1*f*.

FIG. 1*c* shows a thick signature S having a jacket or outer portion of J containing a plurality of inserts I through I''''. The inserts are neatly arranged within jacket J to form a signature S which, although having a blunt nose N, is devoid of any irregularities.

FIG. 1*d* shows a signature S having a jacket J within an irregular contour. Although inserts I, I' and I'' are neatly arranged within jacket J, the inserts I' and I'' have their noses significantly displaced rearwardly from the noses of the inserts I through I'' causing irregularities or humps H, H' to be formed in jacket J.

FIG. 1*e* shows still another anamaly in which a signature S contains inserts I through I''' within its jacket J while an insert I'''' is arranged on the outside of and upon the top surface of jacket J, due to a misfeed by the insertion equipment.

The present invention is directed to a sensor 10 which is characterized by its ability to sense and count thick signatures having irregularities and/or in which misfeeds have occurred in the insertion operation in which one or more inserts can actually be found outside of the signature jacket.

Referring to FIGS. 1*a* through 4, the sensor 10 is shown as being comprised of side plates 12 and 14. Side plates 12 and 14 each have semi-circular grooves 12*a*, 14*a* confirming to the shape of shaft 16 forming part of a signature stacker, not shown for purposes of simplicity, and utilized for positioning and supporting sensor 10 typically within the infeed section of a signature stacker. Mounting clamp 18 cooperates with side plates 12 and 14 and is provided with a substantially semi-circular recess 18*a* conforming to the shape of shaft 16. Side plates 12 and 14 are provided with tapped openings, such as for example, the tapped openings 14*b* shown in FIG. 11*a*, for receiving fasteners 20. Similar tapped openings are provided in side plate 12.

Side plates 12 and 14 are maintained spaced apart by back spacer 22 and front spacer 24 also shown in FIGS. 8*a* through 8*c*. Front spacer 24 has a semicircular cutout 24*a* along its top surface for receiving shaft 16 and is provided with a pair of openings 24*b*, 24*c* for receiving fastening means 26 which join side plates 12 and 14. Fastening means 26 extends through cooperating openings in side plates 12 and 14 and the opposite ends of the fastening means are flush with the outer surfaces of side plates 12 and 14.

Back spacer 22 is hollow and receives fastening means 28 which extends through cooperating openings in side plates 12 and 14 for securing the back ends of these plates together. Fastening means 28 is also mounted flush with the outer surfaces of plates 12 and 14.

Noting for example FIGS. 11*a* and 11*b*, opening 14*c* receives fastening means 28 while openings 14*d*, 14*e* receives fastening means 26.

As shown best in FIG. 4, side plates 12 and 14 are provided with openings 12*b* and 14*f*, respectively, for receiving shaft 30 respectively freewheelingly mounted within openings 12*b* and 14*f* by bearings 32 and 34 respectively.

Shaft 30 extends through and rotatably supports position wheel 36 and sensing wheel 38.

Position wheel 36, in one preferred embodiment is a triangular shaped member defined by sides 36*a*, 36*b* and 36*c*. Openings extend through main body portion 36*d* (note especially FIGS. 9*a* and 9*b*) and these openings 36*e*, 36*f* and 36*g* are arranged inwardly from the apices of the triangular shaped main body portion 36*d*. Extending outwardly from and integral with main body portion 36*d* is a triangular shaped projecting portion 36*h* having a triangular shape which is congruent with the triangular shape of main body portion 36*d*. A central opening 36*i* extends through portions 36*d* and 36*h* for receiving shaft 30. Position wheel 36 is secured to shaft 30 so as to rotate with the rotation of shaft 30.

The plurality of sensing fingers 40 (note especially FIG. 2) are swingably mounted to position wheel 36 by means of pins 42. Since fingers 40 are substantially identical in both design and function, only one finger will be described herein for purposes of simplicity.

Noting FIGS. 2, 6*a* and 6*c*, finger 40 comprises a mounting end 40*a* which is substantially L-shaped and a free end 40*b* which tapers outwardly from L-shaped end 40*a* to form a free end having a portion of which is of increasing width relative to the adjacent L-shaped portion 40*a*. Free end 40*b* then tapers inwardly to form a curved sensing end 40*c*. An elongated, substantially oval-shaped slot 40*d* is provided substantially at the crook of the Ll-shaped portion 40*a*. An opening 40*e* whose longitudinal axis is perpendicular to slot 40*d*, extends through finger 40 to receive pin 42. Oval-shaped slot 40*d* has a portion which tapers outwardly as shown at 40*d*-1. A helical shaped torsion spring 44 is arranged within slot 40*d* such that pin 42 extends therethrough as can best be seen in FIG. 6*a*. One end 44*a* of torsion spring 44 rests against surface 40D-1. The other end 44*b* of torsion spring 44 extends into an opening in pin 42 as shown best in FIG. 6*c*. Torsion spring 44 is wound so as to normally urge sensing finger 40 in an outward radial direction. The adjacent surface 36*h*-1 through 36*h*-3 (see FIG. 2) of integral projection 36*h* limits the extent of the counterclockwise movement of fingers 40 about their respective pins 42 due to the abutment between surfaces 36*h*-1 through 36*h*-3 and the adjacent surfaces 40*f* (see FIG. 6*c*) of each finger 40. Swingable movement of fingers 40 in the clockwise direction is caused by sliding engagement of each finger with the signature as the finger 40 moves into the sensing position, as will be more fully described hereinbelow.

Sensing wheel 38 is shown best in FIGS. 3, 5*a* and 5*b* as comprised of a main disc-shaped portion 38*a* having openings 38*b*, 38*c*, 38*d*. Permanent magnet members 46*a*, 46*b* and 46*c* are mounted within openings 38*b* through 38*d*, respectively in cooperation with a magnetic field sensor to be more fully described.

Integral with and projecting outwardly from disc-shaped portion 38*a* is a cam member 48. Openings 38*e* and 48*a* in members 38*a* and 48 are coaxially aligned to receive and be rigidly secured to shaft 30 (see FIG. 4). Cam member 48, in the embodiment having three sensing fingers, has three low positions 48*a*, 48*b* and 48*c* spaced substantially at 120 degree intervals and three high points 48*d*, 48*e* and 48*f*. Long curved sections 48*g*, 48*h* and 48*i* extend between low point 48*c* and high point 48*f*, low point 48*a* and high portion 48*d*, and low point 48*b* and high pint 48*e*, respectively. Short curved sections 48*j*, 48*k* and 48*l* extend between high point 48*f* and low point 48*a*, high point 48*d* and low point 48*b*, and high point 48*e* and low point 48*c*, respectively. These curved surfaces and the low points cooperate with the detent arm and cam follower roller to be more fully described, to provide the proper detent action as well as forces which aid in stopping the rotating members, which are of rather significant mass, in order to prevent oscillation of the rotating parts and thereby vastly improve the stability of the sensor mechanism.

The detent arm is shown best in FIGS. 3 and 7*a* through 7*c* and is comprised of a substantially L-shaped member 50 provided with an opening 50*a* for receiving a mounting pin 51 for swingable mounting detent arm 50 to side plate 14 (note FIGS. 1*a* and 3). The central portion of arm 50 is provided with an elongated oval-shaped slot 50*b*. An opening 50*c* extends through arm 50 and has its longitudinal axis perpendicular to elongated slot 50*b*. The free end of arm 50 is provided with a slot 50*d* to define a pair of bifurcated arm portions 50*f*, 50*g* having an opening 50*e* extending therethrough and having its longitudinal axis perpendicular to slot 50*d*. A pin 53 is utilized to mount a roller 54 arranged within slot 50*d*. The opposite ends of pin 53 are secured in the opening 50*e* of bifurcated arm portions 50*f* and 50*g*.

A helical biasing spring 56 has a first end secured to the side plate 14 by fastener 58 and has its opposite end extending into slot 50*b* of detent arm 50. A pint 60 is secured to the upper end of biasing spring 56 and has its ends secured within the opposite ends of opening 50*c* of arm 50 which openings are shown best in FIG. 7*b*.

Considering FIG. 3, it can be seen that spring 56 normally urges detent arm 50 counterclockwise about pivot 51 urging cam follower roller 54 against cam surface is such that cam follower roller 54 seeks the lowest point along the cam surface, thus causing sensing wheel 38 to rotate through substantially 120 degree intervals, in a manner to be fully described.

The shaft 30, position wheel 36 and sensing wheel 38 are all free to rotate in the counterclockwise direction as shown in FIG. 2. The members 30, 36 and 38 are, however, prevented from rotating in the clockwise direction relative to FIG. 2 due to the employment of a one-way clutch assembly 58 mounted within clutch mounting block 62 as shown in FIGS. 4, 10*a* and 10*b*. The one-way clutch may, for example, be a one-way roller type clutch manufactured, for example, by Torrington. The roller type clutch 66 is arranged within opening 62*a* of clutch mounting block 62 which is further provided with openings 62*b* and 62*c* for receiving fastening members 64 for securing clutch mounting block 62 to side plate 12. The roller type clutch is comprised of cylindrical housing 66*a* secured against movement within opening 62*a*. A plurality of out-of-round pins 66*b* are arranged between shaft 30 and housing 66*a*. When shaft 30 rotates in the counterclockwise direction as shown in FIGS. 2 and 10*a*, one-way-roller clutch 66 is disengaged from shaft 30. In the event that shaft 30 attempts to rotate in the clockwise direction relative to FIGS. 2 or 10, the out-of-round pins become wedged between housing 66*a* and shaft 30, locking shaft 30 to mounting block 62 and thereby preventing substantially any rotation in the clockwise direction relative to FIG. 2. The oneway roller clutch thus prevents oscillation of the rotating components to provide a more stable and more sensitive sensor mechanism.

A Hall-effect sensor 70 is arranged within an elongated slot 14*g* in side plate 14 as shown best in FIGS. 3 and 11*a*. An L-shaped mounting bracket 72 is secured to side plate 14 by fasteners 74 and has an opening at its upper end through which the electrical conductors 75 provided for coupling power to the Hall-effect sensor 70 and for coupling the Hall-effect sensor 70 to associated electronic circuitry, extends through said opening. A rubber grommet 78 is positioned within opening 72*d* to secure leads 75. Openings 72*a* and 72*b* receive two of the fastening members 74 for securing sensor mounting bracket 72 to side plate 14. The opening 72*c* located between and slightly below openings 72*a* and 72*b* receives fastener 76 which secures sensor 70 to the sensor mounting bracket 72.

As shown best in FIG. 3, the permanent magnet members 46*a* through 46*c* pass the sensing portion 70*a* of sensor 70, which in the preferred embodiment, comprises a Hall-effect sensor which develops a signal which is a function of a change in the magnetic field in the region of sensor portion 70*a*. As the position wheel 36 and cooperating sensing wheel 38 rotate through an angle of 120 degrees so that sensing wheel 38 rotates clockwise as shwon in FIG. 3 moving low point 48*c* to the position presently occupied by low point 48*b*, permanent magnet 46*c* passes sensing portion 70*a* in moving to the position presently occupied by permanent magnet 46*a*, causing a signal to be generated by the Hall-effect sensor 70 which is utilized as a count indicating the passage of one signature.

Considering FIGS. 1 and 2, sensor 10 operates as follows:

When the fingers 40 are in the position shown in FIG. 2, cam follower arm 54 occupies the position shown in FIG. 3 which is a position capable of being stably maintained. In this position, the resiliently-biased arm in the sensing position slideably engages the top surface of a signature and is urged upwardly to the position 40' shown in FIG. 13.

In the even that the rounded tip 40*c'* of finger 40' engages an insert lying on the exterior surface of the signature jacket J or in the event that the rounded tip 40*c'* engages an irregularity or hump in the signature jacket, finger 40' is caused to swing upwardly against the resilient biasing force of spring 56. When the nose N' of signature S' shown in FIG. 13*a* engages the free end of finger 40', the finger is urged to the outermost radial position occupied by finger 40' in FIG. 2. As signature S' within the signature stream moves in the feed direction shown by arrow F, finger 40', position wheel 36, sensing wheel 38 and shaft 30 all rotate in the counterclockwise direction urging cam follower roller 54 out of low point 48*b* shown in FIG. 3 whereby arm 50 is moved upwardly against the force spring 56 in order to follow the cam surface of the cam member 48. Since the collective mass of the rotating components 30, 36, 38 and 40 is quite large, it is important to be able to stop the rotating members at the desired detent position. The design of detent force strong enough to always stop rotating members at the lowest point of the detent cam 48 is not feasible since such a force would inhibit the capability of a signature to index the rotating assembly. Thus, the cam member 48 is designed to allow the detent arm cam follower roller 54 to climb the detent cam 48 after it has reached its lowest point and this will decelerate the rotating assembly. Thus, when the sensing wheel 38 is rotated through a 120 degree angle, the inertia of the rotating parts will cause the rotating parts to move beyond the low point on cam 48 whereupon cam follower roller 54 will attempt to climb the curved cam portion causing stretching of spring 56 to exert an increasing stopping force upon the sensing wheel 38 through arm 50 and cam follower roller 54. This increased force decelerates the rotating assembly.

In order to avoid oscillation which may be caused by the cam follower roller 54 attempting to return to the lowest point, one-way roller clutch 58 prevents rotation in the counterclockwise direction relative to FIG. 3 (and in the clockwise direction relative to FIG. 2) thereby preventing shaft 30, sensing wheel 36 and position wheel 38 from moving backwards.

Since the sensing fingers 40 are spring-loaded, they will adjust to any product thickness and to changes in product thickness.

The initial force imparted to the free end 40*c* of each sensing finger by the signature nose is sufficient to move the cam follower roller 54 out of a low point, such as for example, low point 48*b* and beyond the next high point. Even after the signature nose has been moved beyond the sensing finger, once the cam follower roller 54 is moved past the high point, the energy in charged spring 56 is sufficient to move the cam follower roller 54 downwardly along cam 48 to the next low point assuring indexing of the position wheel 36 and sensing wheel 38 through an angle of 120 degrees. Even though the sensing wheel may move beyond the next low point in the cam 48, the increasing force imparted to the sensing wheel due to the charging of spring 56 rapidly decelerates the sensing wheel 38 and hence the position wheel 36. Since the permanent magnets 48 or 46*c* are located between each pair of adjacent positions, there is no danger of generating a false count if the cam moves more than 180 degrees.

After a signature S has caused the rotating assembly to index 120 degrees, the next pick-up finger incline will, in the preferred embodiment, engage the surface of the signature approximately 3 inches behind the nose of the just counted signature which caused the indexing action. At that time, the pick-up finger which occupies the floating position 40*c''* (see FIG. 2) slidingly engages the high part of the signature and is aligned almost horizontally. The rounded tip of each pick-up finger enables the pick-up finger to ride over any hump or misfed insert on top of the signature thus avoiding the counting of any humps or irregularities in the signature.

As the tip 40*c* of each pick-up finger moves closer to the nose of the next signature, the finger easily follows the natural contour between two adjacent signatures due to the novel shape of the fingers, which substantially conforms to the aforesaid contour between signatures.

The spring loading of each pick-up finger 40 automatically allows each pick-up finger to adjust to any product thickness, enabling the sensor of the present invention to be used to count even thin signatures. the spring loading arrangement eliminates the problem of having the sensor rest upon the signature stream thereby undesireably placing the entire sensor weight upon the pick-up finger. The elimination of this state-of-the-art technique eliminates the application of excessive lateral forces on the rotating assembly. On fixed pick-up finger models, lateral forces can and will cause the rotation assembly to index even in the absence of a nose of a signature thereby causing an erroneous count.

The size and geometry of the position wheel and sensing fingers is chosen, in one prefered emboidment, to bring the next finger incline into engagement with the just counted signature approximately 3 inches behind the nose of the last counted signature thus preventing any irregularities, humps or misfed inserts from having any effect whatsoever on the signature count. Humps, irregularities or missed inserts occurring at a distance beyond the aforementioned three inch interval engage the free tip 40*c* of the sensing finger 40 which is curved and which cooperates with the resilient biasing spring 56 to allow the finger 40 to automatically adjust to signature thickness as well as abrupt changes in signature thickness.

Although the preferred embodiment described hereinabove disclosed an arrangement utilizing three sensing fingers, it should be understood that more or less sensing fingers may be provided. For example, it is possible, using the same design as described herein, to employ as few as two sensing fingers and more than three sensing fingers (for example, four sensing fingers). For example, in the two sensing finger embodiment, the sensing fingers are located 180 degrees apart and the cam is arranged with two low points 180 degrees apart and having first and second curved sections between each low point for causing the cam follower roller to first be urged upwardly out of one detent and thereafter downwardly toward the opposite detent in order to accomplish substantially the same result as the embodiment described herein. The size of the position wheel and sensing wheel may be altered accordingly.

In the four finger embodiment, shown in FIG. 12, the fingers 40 are arranged at 90 degree intervals along the position wheel 36', the sensing wheel (not shown) is provided with four low points each 90 degrees apart and first and second curved sections between each adjacent low point to cause the cam follower roller to first move away and thereafter move back toward the axis of rotation of the cam to obtain the same detent action described hereinabove for a 90 degree rotation. Of course, the position wheel and sensing wheel may be sized accordingly.

Although the preferred embodiment employs a Hall-effect sensor 70 and cooperating permanent magnets 46*a*–46*c*, other types of sensors may be employed, if desired. For example, the Hall-effect sensor may be substituted by a cooperating light source and light sensing element positioned on opposite sides of the sensing wheel and the permanent magnets may be replaced simply by openings whereupon count pulses are developed as an opening passes between the cooperating light source and light sensing element. As another alternative embodiment, Hall-effect sensor 70 may be replaced by an electric coil type sensor which generates a signal due to the presence of a changing magnetic field in a manner some what similar to that of the Hall-effect sensor 70. Although the parts may tend to wear rapidly, the sensor may comprise a mechanical sensing finger slideably engaging either a depression or a projection around the sensing wheel, each depression or projection being arranged at a position presently occupied by a permanent magnet. The physical movement of the sensing arm slideably engaging the recess or projection may be used to open or close the switch and thereby provide a count pulse. As another alternative, the permanent magnet can be replaced by conductive members and the sensor may comprise a wiper arm which completes an electrical path as it engages each conductive member to effect the count pulse.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for sensing and counting a moving stream of signatures and the like and especially signatures having misfed and/or improperly positioned inserts, said apparatus comprising;

a housing;

said housing having an opening facing said signature stream;

a member rotatably mounted in and contained within said housing and adjacent to the path of movement of signatures, said signatures moving along said path in overlapping fashion with the folded edge of the signatures comprising the leading edge thereof;

a plurality of fingers each being swingably mounted upon said rotatably mounted member at spaced intervals therealong for rotating said rotatably mounted member in a first direction when the finger is engaged and moved by the nose of a signature to move the finger away from the signature stream and to bring the next finger into sliding engagement with the signature stream;

said fingers being normally resiliently biased to sequentially extend in a first direction outwardly through said opening and toward said signature stream to slidably engage the adjacent surface of a passing signature;

a cam rotatable with said rotatable member and having a cam surface;

a movable detent member having a cam follower surface slideably engaging said cam surface;

resilient bias means normally urging said detent member into engagement with said cam surface;

said cam surface having a plurality of detents each selectively engaged by said cam follower to substantially limit rotation of the rotatably mounted member, and having a decelerating cam surface portion cooperating with the follower member for decelerating the rotatably mounted member when the rotatably mounted member rotates to move the detent member away from a detent in the cam follower surface.

2. The apparatus of claim 1 further comprising one-way clutch means to prevent the rotatably mounted member from rotating in a second direction opposite said first direction.

3. The apparatus of claim 2 wherein said one-way clutch means comprises a one-way roller clutch.

4. The apparatus of claim 1 further comprising sensing means for sensing rotation of the rotatably mounted member through at least a predetermined angle for counting signatures.

5. The apparatus of claim 4 wherein said sensing means comprises magnetic field sensing means, a plurality of magnets arranged about said rotatably mounted member, each being associated with a sensing finger for movement past said magnetic field sensing means as the rotatably mounted member moves from one detent to the next for generating a signature counting pulse.

6. The apparatus of claim 4 further comprising a stationary sensing member and a plurality of sensed members arranged at equi-spaced intervals about said rotating member for activating said sensing member as each sensed member passes the sensing member.

7. The apparatus of claim 6 wherein the rotatably mounted member comprises a position wheel and a sensing wheel mounted upon a common shaft and arranged to rotate in unison;

said cam surface being arranged on said sensing wheel;

said sensing fingers being swingably mounted upon said sensing wheel;

said sensing wheel having abutting surfaces engageable with each sensing finger for limiting the movement of the free end of each sensing finger away from said sensing wheel.

8. The apparatus of claim 6 wherein the surface of said cam between adjacent low points comprises a high point, a deceleration portion between one of the adjacent low points and the high point and an acceleration surface between the high point and the remaining one of the adjacent low points.

9. The apparatus of claim 1 wherein the sensing fingers are shaped to conform to the surface of a signature in an overlapping signature stream to facilitate movement between the engaging surfaces of adjacent signatures.

10. The apparatus of claim 1 wherein the free end of each sensing finger is shaped to slide over irregularities or humps in a signature as the signature passes the sensing finger, said resilient biasing force enabling the sensing finger slidably engaging the signature to automatically adjust to signature thickness.

11. The apparatus of claim 1 wherein the cam surface of said cam comprises a plurality of low points equal in number to the number of sensing fingers and equally spaced from one another about said cam;

the surface of said cam between each two adjacent low points being shaped to initially urge the cam follower surface away from the axis of rotation of said cam and thereafter to permit the cam follower surface to move toward the axis of rotation of said cam to abruptly decelerate the cam as it passes each low point on the cam surface.

12. The apparatus of claim 1 wherein said detent member comprises an arm pivotally mounted at one end and having said cam follower surface arranged at the opposite free end of said arm;

spring means coupled to said arm for urging said cam follower surface into engagement with said cam.

13. The apparatus of claim 12 wherein said cam follower surface comprises a cam follower roller rotatably mounted to the free end of said arm.

14. The apparatus of claim 1 further comprising a clamping member and fastening means securing said clamping member to said housing for gripping a supporting shaft therebetween for mounting said housing.

15. The apparatus of claim 1 wherein said housing comprises a pair of side plates separated by spacer members.

16. The apparatus of claim 15 wherein said rotatably mounted member is arranged in the hollow region between said side plates;

a shaft extending beween said side plates for rotatably mounting said rotatably mounted member.

17. The apparatus of claim 16 including bearing means for freewheelingly mounting said shaft to said side plates.

18. The apparatus of claim 15 further comprising a one-way clutch coupled between one of said side plates and said shaft for preventing said shaft from rotating in one direction while permitting the shaft to rotate in the opposite direction.

19. The apparatus of claim 18 wherein said sensing wheel and said position wheel are secured to said shaft.

20. The apparatus of claim 1 wherein said plurality of sensing fingers are pivotally mounted to said rotatably mounted member.

21. The apparatus of claim 1 wherein three sensing fingers are swingably mounted upon said rotatably mounted member.

22. The apparatus of claim 1 wherein four sensing fingers are swingably mounted upon said rotatably mounted member.

23. The apparatus of claim 1 wherein the separation distance between adjacent fingers mounted to said rotatably mounted member causes each finger to make initial engagement with a signature at a point which is a predetermined distance downstream from the nose of the signature to prevent irregularities located between the nose and said point from rotating said rotatably mounted member.

24. The apparatus of claim 23 wherein said predetermined distance is approximately three (3) inches.

25. The apparatus of claim 24 wherein the said acceleration and deceleration surface portions are of differing lengths.

26. The apparatus of claim 1 further comprising stop means on said rotatably mounted member for limiting movement of each finger relative to said rotatably mounted member whereby movement of a finger by the nose of a signature is imparted to the moveably mounted member when the sensing finger engages the stop means.

27. Apparatus for sensing and counting signatures and the like in a signature stream and especially signatures having misfed and/or improperly positioned inserts, said apparatus comprising;

a housing;

a member rotatably mounted in said housing and positioned adjacent to the path of movement of signatures, said signatures moving along said path in overlapping fashion with the folded edge of the signatures comprising the leading edge thereof;

a plurality of sensing fingers each swingably mounted upon said rotatably mounted member at spaced intervals therealong for rotating said rotatably mounted member in a first direction when the finger is moved by the nose of a signature out of engagement with the signature stream;

said housing having an opening facing the path of movement of said signature stream;

said fingers being normally resiliently biased to extend through said opening and toward said signature stream;

detent means for halting the rotatably mounted member after movement of the rotatably mounted member through a predetermined angle to position the next sensing finger in a position to slidably engage the leading edge of the next signature to be counted and to slideably engage the signature just counted.

* * * * *

UNITED STATES PATENT AND TRADEMARK OFFICE

CERTIFICATE OF CORRECTION

PATENT NO. : 4,562,339

DATED : December 31, 1985

INVENTOR(S) : CHRISTER A. SJOGREN, ET AL

It is certified that error appears in the above-identified patent and that said Letters Patent is hereby corrected as shown below:

Column 4, line 6, change " I' and I" " to --I'" and I"" --;

Column 5, line 19, change "Ll-shaped" to --L-shaped--;

Column 5, line 26, change "40D-1" to --40d-1--;

Column 7, line 28, change "even" to --event--; and

Column 9, line 4, change "disclosed" to --discloses--.

Signed and Sealed this

*Nineteenth* Day of *August 1986*

[SEAL]

*Attest:*

DONALD J. QUIGG

*Attesting Officer*

*Commissioner of Patents and Trademarks*